US009516447B2

(12) United States Patent
Wu et al.

(10) Patent No.: US 9,516,447 B2
(45) Date of Patent: Dec. 6, 2016

(54) METHOD AND APPARATUS FOR GENERATING AND RESTORING DOWNMIXED SIGNAL

(71) Applicant: Huawei Technologies Co., Ltd., Shenzhen, Guangdong (CN)

(72) Inventors: Wenhai Wu, Beijing (CN); Lei Miao, Beijing (CN); Yue Lang, Munich (DE); David Virette, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 237 days.

(21) Appl. No.: 14/227,695

(22) Filed: Mar. 27, 2014

(65) Prior Publication Data

US 2014/0211947 A1 Jul. 31, 2014

Related U.S. Application Data

(63) Continuation of application No. PCT/CN2012/082180, filed on Sep. 27, 2012.

(30) Foreign Application Priority Data

Sep. 27, 2011 (CN) ..... 2011 1 0289391

(51) Int. Cl.
*H04S 5/02* (2006.01)
*H04S 3/00* (2006.01)
(Continued)

(52) U.S. Cl.
CPC ..... *H04S 3/02* (2013.01); *G10L 19/008* (2013.01); *G10L 19/02* (2013.01)

(58) Field of Classification Search
CPC ... H04S 3/02; H04S 2420/01; G10L 19/008; G10L 25/18
USPC ..... 381/17–19, 22–23, 97
See application file for complete search history.

(56) References Cited

U.S. PATENT DOCUMENTS

2008/0071549 A1* 3/2008 Chong ..... G10L 19/008 704/500
2008/0126104 A1* 5/2008 Seefeldt ..... G10L 19/008 704/503

(Continued)

FOREIGN PATENT DOCUMENTS

CN 102157149 A 8/2011
CN 102157150 A 8/2011

(Continued)

OTHER PUBLICATIONS

Jeroen Breebaart, et al., "Parametric Coding of Stereo Audio", EURASIP Journal on Applied Signal Processing, Jan. 27, 2004, p. 1305-1322.

*Primary Examiner* — George Monikang

(57) ABSTRACT

An embodiment of the present invention provides a method for generating a downmixed signal, including: performing a time-frequency transform on a received left sound channel signal and a received right sound channel signal to obtain a frequency domain signal, and dividing the frequency domain signal into several frequency bands; calculating a sound channel energy ratio and a sound channel phase difference of each frequency band; calculating a phase difference between the downmixed signal and a first sound channel signal in each frequency band according to the sound channel energy ratio and the sound channel phase difference; and calculating a frequency domain downmixed signal according to the left sound channel signal, the right sound channel signal, and the phase difference between the downmixed signal and the first sound channel signal in each frequency band. This method effectively improves quality of stereo encoding and decoding.

12 Claims, 2 Drawing Sheets

(51) Int. Cl.

| | |
|---|---|
| ***H04S 3/02*** | (2006.01) |
| ***G10L 19/008*** | (2013.01) |
| ***G10L 19/02*** | (2013.01) |

(56) References Cited

U.S. PATENT DOCUMENTS

| | | | |
|---|---|---|---|
| 2009/0210236 | A1 | 8/2009 | Moon et al. |
| 2012/0189127 | A1 | 7/2012 | Wu et al. |
| 2012/0300945 | A1 | 11/2012 | Wu et al. |
| 2012/0308018 | A1 | 12/2012 | Miao et al. |

FOREIGN PATENT DOCUMENTS

| | | | |
|---|---|---|---|
| CN | 102157152 | A | 8/2011 |
| CN | 102165519 | A | 8/2011 |
| CN | 102446507 | A | 5/2012 |
| EP | 2 352 152 | A2 | 8/2011 |

* cited by examiner

METHOD AND APPARATUS FOR GENERATING AND RESTORING DOWNMIXED SIGNAL

CROSS-REFERENCE TO RELATED APPLICATIONS

This application is a continuation of International Application No. PCT/CN2012/082180, filed on Sep. 27, 2012, which claims priority to Chinese Patent Application No. 201110289391.X, filed on Sep. 27, 2011, both of which are hereby incorporated by reference in their entireties.

TECHNICAL FIELD

The present invention relates to the field of stereo encoding and decoding, and in particular, to a method and an apparatus for generating and restoring a downmixed signal.

BACKGROUND

In most methods among existing stereo encoding methods, left and right sound channel signals are downmixed to obtain a mono signal, and sound field information of left and right sound channels is transmitted as a sideband signal. The sound field information of the left and right sound channels generally includes an energy ratio of the left sound channel to the right sound channel, a phase difference between the left and right sound channels, a cross-correlation parameter of the left and right sound channels, and a parameter of a phase difference between a first sound channel or a second sound channel and a downmixed signal. In the existing methods, the parameters are used as side information, and are coded and sent to a decoding end, to restore a stereo signal.

In these kinds of methods, downmixing methods and extraction and synthesis of the sound field information of the left and right sound channels are all core technologies, and currently there are many research results in the industry. Existing stereo downmixing methods may be classified into two kinds, namely, passive downmixing and active downmixing.

A passive downmixing algorithm is simple and has a short time delay, and calculation is generally performed by using 0.5 as a downmixing factor:

$$m(n)=0.5\cdot(x_1(n)+x_2(n))$$

where $x_1(n)$ and $x_2(n)$ represent a left sound channel signal and a right sound channel signal respectively, and m(n) represents a downmixed signal.

When left and right sound channels have completely opposite phases and have a same amplitude, the downmixed signal is 0, and a decoding end is incapable of restoring the left and right sound channels. Even if the phases are not completely opposite to each other, energy missing of the downmixed signal may still be caused.

In order to resolve the problem of the energy missing of the downmixed signal caused by the passive algorithm, in an active downmixing algorithm, a time-frequency transform is performed on left and right signals first, and an amplitude and/or a phase of the signal is adjusted in a frequency domain, so as to keep energy of the downmixed signal as much as possible. The following is an example of phase adjustment.

First, a time-frequency transform is performed on a left signal and a right signal to obtain $X_1(k)$ and $X_2(k)$, and a phase difference in each sub-band is calculated in a frequency domain; then phase rotation is performed on the right signal according to the phase difference, to obtain a signal $X_2^r(k)$ after the phase rotation. After the rotation, a phase of the right sound channel signal keeps consistent with a phase of the left signal. Then, $X_2^r(k)$ and $X_1(k)$ with the adjusted phases are added and then multiplied by 0.5 to obtain a downmixed signal of the frequency domain according to the following formula: $M(k)=0.5\cdot(X_2^r(k)+X_1(k))$; finally, a downmixed signal of a time domain is obtained through a time-frequency inverse transform. This kind of method can resolve the problem of energy missing caused by opposite phases of left and right sound channel signals.

However, the existing downmixing method has a problem that downmixing performance of a stereo signal is affected by factors that phases of left and right sound channels are opposite and undergo transition frequently and a phase difference between the left and right sound channels changes quickly, thereby lowering subjective quality of stereo encoding and decoding.

SUMMARY

Embodiments of the present invention provide a method and an apparatus for generating and restoring a downmixed signal, so as to improve quality of stereo encoding and decoding.

An embodiment of the present invention provides a method for generating a downmixed signal, where the method includes: performing a time-frequency transform on a left sound channel signal and a right sound channel signal to obtain a frequency domain signal, and dividing the frequency domain signal into several frequency bands; calculating a sound channel energy ratio and a sound channel phase difference of each frequency band, where the sound channel energy ratio reflects energy ratio information of the left sound channel signal and the right sound channel signal in each frequency band, and the sound channel phase difference reflects phase difference information of the left sound channel signal and the right sound channel signal in each frequency band; calculating a phase difference between a downmixed signal and a first sound channel signal in each frequency band according to the sound channel energy ratio and the sound channel phase difference, where the first sound channel signal is the left sound channel signal or the right sound channel signal; and calculating a frequency domain downmixed signal according to the left sound channel signal, the right sound channel signal, and the phase difference between the downmixed signal and the first sound channel signal in each frequency band.

An embodiment of the present invention provides an apparatus for generating a downmixed signal, including: a time-frequency transform unit, configured to perform a time-frequency transform on a received left sound channel signal and a received right sound channel signal to obtain a frequency domain signal, and divide the frequency domain signal into several frequency bands; a frequency band calculating unit, configured to calculate a sound channel energy ratio and a sound channel phase difference of each frequency band, where the sound channel energy ratio reflects energy ratio information of the left sound channel signal and the right sound channel signal in each frequency band, and the sound channel phase difference reflects phase difference information of the left sound channel signal and the right sound channel signal in each frequency band; a phase difference calculating unit, configured to calculate a phase difference between a downmixed signal and a first sound channel signal in each frequency band according to the sound channel energy ratio and the sound channel phase difference, where the first sound channel signal is the left sound channel signal or the right sound channel signal; and a downmixed signal calculating unit, configured to calculate a frequency domain downmixed signal according to the left sound channel signal, the right sound channel signal, and the phase difference between the downmixed signal and the first sound channel signal in each frequency band.

An embodiment of the present invention provides a method for restoring a downmixed signal, including: calculating a frequency domain signal amplitude of a left sound channel signal and a frequency domain signal amplitude of a right sound channel signal separately according to a frequency domain signal amplitude of a downmixed signal and a received sound channel energy ratio, where the sound channel energy ratio reflects energy ratio information of the left sound channel signal and the right sound channel signal in each frequency band; calculating a frequency domain signal phase of the left sound channel signal and a frequency domain signal phase of the right sound channel signal separately according to a frequency domain signal phase of the downmixed signal, the sound channel energy ratio, and a received sound channel phase difference, where the sound channel phase difference reflects phase difference information of the left sound channel signal and the right sound channel signal in each frequency band; and synthesizing a frequency domain signal of the left sound channel signal according to the frequency domain signal amplitude and the frequency domain signal phase of the left sound channel signal, and synthesizing a frequency domain signal of the right sound channel signal according to the frequency domain signal amplitude and the frequency domain signal phase of the right sound channel signal.

An embodiment of the present invention provides an apparatus for restoring a downmixed signal, including: a signal amplitude calculating unit, configured to calculate a frequency domain signal amplitude of a left sound channel signal and a frequency domain signal amplitude of a right sound channel signal separately according to a frequency domain signal amplitude of the downmixed signal and a received sound channel energy ratio, where the sound channel energy ratio reflects energy ratio information of the left sound channel signal and the right sound channel signal in each frequency band; a signal phase calculating unit, configured to calculate a frequency domain signal phase of the left sound channel signal and a frequency domain signal phase of the right sound channel signal separately according to a frequency domain signal phase of the downmixed signal, the received sound channel energy ratio, and a received sound channel phase difference, where the sound channel phase difference reflects phase difference information of the left sound channel signal and the right sound channel signal in each frequency band; and a frequency domain signal calculating unit, configured to synthesize a frequency domain signal of the left sound channel signal according to the frequency domain signal amplitude and the frequency domain signal phase of the left sound channel signal, and synthesize a frequency domain signal of the right sound channel signal according to the frequency domain signal amplitude and the frequency domain signal phase of the right sound channel signal.

In the methods and apparatuses according to the embodiments of the present invention, interference caused to downmixing performance by factors, such as that phases of left and right sound channels are opposite and undergo transition and a phase difference between the left and right sound channels changes quickly, is reduced, thereby effectively improving quality of stereo encoding and decoding.

BRIEF DESCRIPTION OF THE DRAWINGS

To describe the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and a person of ordinary skill in the art can derive other drawings from the accompanying drawings without creative efforts.

It should be understood by a person skilled in the art that the accompanying drawings are merely schematic diagrams of an exemplary embodiment, and modules or processes in the accompanying drawings are not necessarily required in implementing the present invention.

DETAILED DESCRIPTION

In order to make the objectives, technical solutions, and advantages of the present invention more comprehensible, the technical solutions according to embodiments of the present invention are clearly and completely described in the following with reference to the accompanying drawings. Apparently, the embodiments in the following description are merely a part rather than all of the embodiments of the present invention. All other embodiments obtained by a person of ordinary skill in the art based on the embodiments of the present invention without creative efforts shall fall within the protection scope of the present invention.

An embodiment of the present invention provides a method for generating a downmixed signal, and the method includes:

performing a time-frequency transform on a received left sound channel signal and a received right sound channel signal to obtain a frequency domain signal, and dividing the frequency domain signal into several frequency bands;

calculating a sound channel energy ratio (Channel Level Difference, CLD) and a sound channel phase difference (Internal Phase Difference, IPD) of each frequency band, where the sound channel energy ratio reflects energy ratio information of the left sound channel signal and the right sound channel signal in each frequency band, and the sound channel phase difference reflects phase difference information of the left sound channel signal and the right sound channel signal in each frequency band;

calculating a phase difference between a downmixed signal and a first sound channel signal in each frequency band according to the sound channel energy ratio and the sound channel phase difference, where the first sound channel signal is the left sound channel signal or the right sound channel signal; and calculating a frequency domain downmixed signal according to the left sound channel signal, the right sound channel signal, and the phase difference between the downmixed signal and the first sound channel signal in each frequency band.

Figure 1:
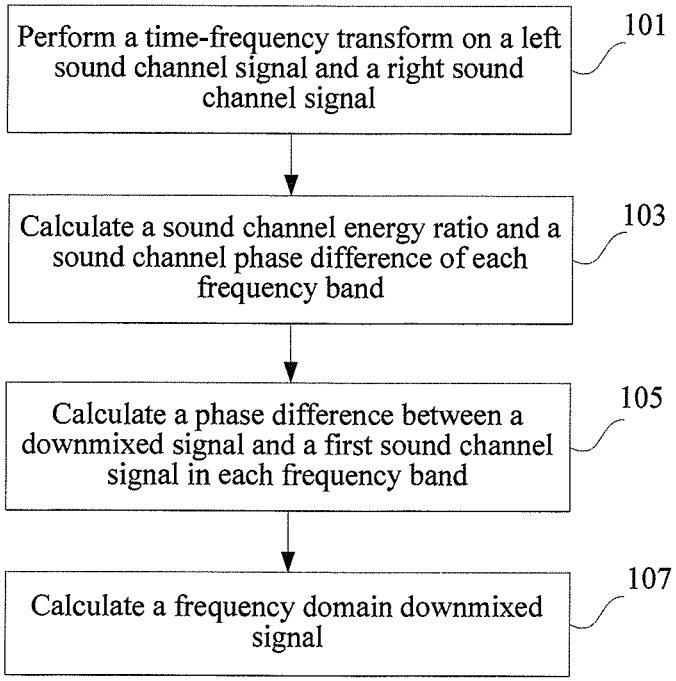
FIG. 1 is a flowchart of a method for generating a downmixed signal according to an embodiment of the present invention.
Figure 2:
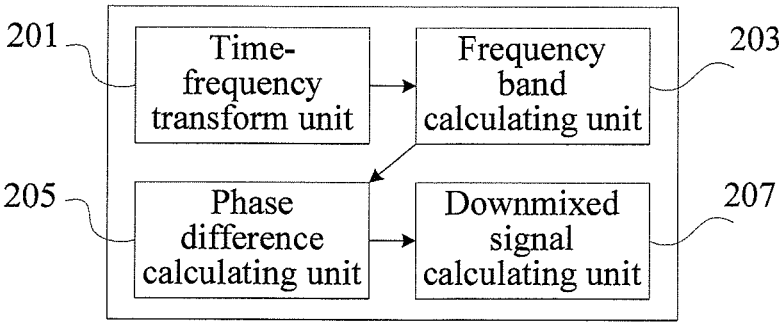
FIG. 2 is a structural diagram of an apparatus for generating a downmixed signal according to an embodiment of the present invention.

Referring to FIG. 1, FIG. 1 is a flowchart of a method for generating a downmixed signal by using a left sound channel signal and a right sound channel signal according to an embodiment, and steps include:

S101: Perform a time-frequency transform on a received left sound channel signal and a received right sound channel signal to obtain a frequency domain signal, and divide the frequency domain signal into several frequency bands.

S103: Calculate a sound channel energy ratio and a sound channel phase difference of each frequency band.

S105: Calculate a phase difference between a downmixed signal and a first sound channel signal in each frequency band.

S107: Calculate a frequency domain downmixed signal.

S101: Perform a time-frequency transform on a left sound channel signal and a right sound channel signal. In a specific implementation method, transform methods such as Fourier transform (Fourier Transform, FT), fast Fourier transform (Fast Fourier Transform, FFT), and quadrature mirror filterbanks (Quadrature Mirror Filterbanks, QMF) may be used. The left sound channel signal and the right sound channel signal are transformed in a frequency domain to obtain L(k) and R(k) respectively.

The frequency domain signal is divided into several frequency bands, and in an embodiment of the present invention, a frequency band width is 1. It is assumed that k is a frequency point index, b is a frequency band index, and $k_b$ is a starting frequency point index of a $b^{th}$ frequency band.

S103: Calculate a CLD and an IPD of each frequency band, which includes calculating according to the following formulas:

$$CLD(b) = 10\log_{10}\frac{\sum_{k=k_b}^{k_{b+1}-1} X_1(k)X_1^*(k)}{\sum_{k=k_b}^{k_{b+1}-1} X_2(k)X_2^*(k)}; \text{ and}$$

$$IPD(b) = \angle cor(b), \text{ where } cor(b) = \sum_{k=k_b}^{k=k_{b+1}-1} X_1(k)X_1^*(k)$$

and $X_1$ (k) is the left sound channel signal, and $X_2$ (k) is the right sound channel signal.

S105: Calculate a phase difference between a downmixed signal and a first sound channel signal in each frequency band.

Embodiment 1

In an embodiment of the present invention, the first sound channel is a left sound channel.

A phase difference between a downmixed signal and a left sound channel signal in each frequency band is calculated according to the following formula:

$$\theta(b) = \frac{1}{1+c(b)}\cdot IPD(b);$$

$$\text{where } c(b) = 10^{CLD(b)/10}$$

and

CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

As energy of the left sound channel signal increases, the phase difference between the downmixed signal and the left sound channel signal decreases; and as energy of the right sound channel signal increases, the phase difference between the downmixed signal and the left sound channel signal increases, and the phase difference between the downmixed signal and the right channel signal decreases. The phase difference between the downmixed signal and the left sound channel is in a positive relationship with the energy of the left sound channel signal, the phase difference between the downmixed signal and the left sound channel signal is in an inverse relationship with the energy of the right sound channel signal, and the phase difference between the downmixed signal and the left sound channel is in a positive relationship with the sound channel phase difference.

S107: Calculate the frequency domain downmixed signal. The frequency domain downmixed signal is calculated according to the following formulas:

$$M_r(k) = 0.5\left(1+\frac{R_{mag}(k)}{L_{mag}(k)}\right)(L_r(k)\cos(\theta(b)) + L_i(k)\sin(\theta(b))); \text{ and}$$

$$M_i(k) = 0.5\left(1+\frac{R_{mag}(k)}{L_{mag}(k)}\right)(L_i(k)\cos(\theta(b)) - L_r(k)\sin(\theta(b))),$$

where k is the frequency point index, $L_r$(k) is a real part of the left sound channel signal at a $k^{th}$ frequency point after time-frequency transform, $L_i$(k) is an imaginary part of the left sound channel signal at the $k^{th}$ frequency point after the time-frequency transform, $R_{mag}$(k) is an amplitude of the right sound channel signal at the $k^{th}$ frequency point after the time-frequency transform, $L_{mag}$(k) is an amplitude of the left sound channel signal at the $k^{th}$ frequency point after the time-frequency transform, $M_i$(k) is a real part of the downmixed signal at the $k^{th}$ frequency point after the time-frequency transform, $M_r$(k) is an imaginary part of the downmixed signal at the $k^{th}$ frequency point after the time-frequency transform, and θ(b) is the phase difference between the downmixed signal and the first sound channel signal in the $b^{th}$ frequency band.

Embodiment 2

In another embodiment of the present invention, the first sound channel is a right sound channel.

A phase difference between a downmixed signal and a right sound channel signal in each frequency band is calculated according to the following formula:

$$\theta(b) = \frac{c(b)}{1 + c(b)} \cdot IPD(b);$$

where $c(b) = 10^{CLD(b)/10}$, and

CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

As energy of the left sound channel signal increases, the phase difference between the downmixed signal and the right sound channel signal decreases, and the phase difference between the downmixed signal and the left sound channel decreases; as the energy of the right sound channel signal increases, the phase difference between the downmixed signal and the right sound channel signal decreases. The phase difference between the downmixed signal and the right sound channel signal is in an inverse relationship with the energy of the right sound channel signal, and the phase difference between the downmixed signal and the right sound channel signal is in a positive relationship with the energy of the left sound channel signal, and is in a positive relationship with the sound channel phase difference.

S107: Calculate the frequency domain downmixed signal. The frequency domain downmixed signal is calculated according to the following formulas:

$$M_i(k) = 0.5\left(1 + \frac{L_{mag}(k)}{R_{mag}(k)}\right)(R_i(k)\cos(\theta(b)) + R_r(k)\sin(\theta(b))); \text{ and}$$

$$M_r(k) = 0.5\left(1 + \frac{L_{mag}(k)}{R_{mag}(k)}\right)(R_r(k)\cos(\theta(b)) - R_i(k)\sin(\theta(b))),$$

where k is the frequency point index, $L_r(k)$ is a real part of the left sound channel signal at a $k^{th}$ frequency point after time-frequency transform, $L_i(k)$ is an imaginary part of the left sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

Embodiment 3

In another embodiment of the present invention, the first sound channel is a sound channel having a greater signal amplitude in the left sound channel and the right sound channel.

If the amplitude of the left sound channel signal is greater than the amplitude of the right sound channel signal, the first sound channel is the left sound channel, and the phase difference between the downmixed signal and the sound channel having the greater signal amplitude in the left sound channel and the right sound channel is calculated according to the following formula:

$$\theta(b) = \frac{1}{1 + c(b)} \cdot IPD(b);$$

where $c(b) = 10^{CLD(b)/10}$.

S107: Calculate the frequency domain downmixed signal. The frequency domain downmixed signal is calculated according to the following formulas:

$$M_r(k) = 0.5\left(1 + \frac{R_{mag}(k)}{L_{mag}(k)}\right)(L_r(k)\cos(\theta(b)) + L_i(k)\sin(\theta(b))); \text{ and}$$

$$M_i(k) = 0.5\left(1 + \frac{R_{mag}(k)}{L_{mag}(k)}\right)(L_i(k)\cos(\theta(b)) - L_r(k)\sin(\theta(b))),$$

where k is the frequency point index, $L_r(k)$ is a real part of the left sound channel signal at a $k^{th}$ frequency point after time-frequency transform, $L_i(k)$ is an imaginary part of the left sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

If the amplitude of the right sound channel signal is greater than the amplitude of the left sound channel signal, the first sound channel is the right sound channel, and the phase difference between the downmixed signal and the sound channel having the greater signal amplitude in the left sound channel and the right sound channel is calculated according to the following formula:

$$\theta(b) = \frac{c(b)}{1 + c(b)} \cdot IPD(b);$$

where $c(b) = 10^{CLD(b)/10}$.

S107: Calculate the frequency domain downmixed signal. The frequency domain downmixed signal is calculated according to the following formulas:

$$M_i(k) = 0.5\left(1 + \frac{L_{mag}(k)}{R_{mag}(k)}\right)(R_i(k)\cos(\theta(b)) + R_r(k)\sin(\theta(b))); \text{ and}$$

$$M_r(k) = 0.5\left(1 + \frac{L_{mag}(k)}{R_{mag}(k)}\right)(R_r(k)\cos(\theta(b)) - R_i(k)\sin(\theta(b))),$$

where k is the frequency point index, $L_r(k)$ is a real part of the left sound channel signal at a $k^{th}$ frequency point after time-frequency transform, $L_i(k)$ is an imaginary part of the left sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

The method for generating a downmixed signal according to the embodiment of the present invention not only has the advantages of Embodiment 1 and Embodiment 2, but also can effectively resolve the problem that a fast transform of a small signal phase affects stereo downmixing performance.

Embodiment 4

In another embodiment of the present invention, after the phase difference between the downmixed signal and the first sound channel signal in each frequency band is calculated according to the sound channel energy ratio and the sound channel phase difference, the method further includes: updating the phase difference between the downmixed signal and the first sound channel according to a group phase, where the group phase reflects similarity between frequency domain envelopes of the left sound channel signal and the right sound channel signal.

In an embodiment of the present invention, a group phase $\theta_g$ is an average of IPDs of frequency bands.

If the first sound channel is the left sound channel: the phase difference between the downmixed signal and the left sound channel signal in each frequency band is calculated according to the following formula:

$$\theta(b) = \frac{1}{1 + c(b)} \cdot (IPD(b) - \theta_g);$$

$$\text{where } c(b) = 10^{CLD(b)/10},$$

and

CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

As energy of the left sound channel signal increases, the phase difference between the downmixed signal and the left sound channel signal decreases; and as energy of the right sound channel signal increases, the phase difference between the downmixed signal and the right sound channel signal decreases.

S107: Calculate the frequency domain downmixed signal. The frequency domain downmixed signal is calculated according to the following formulas:

$$M_r(k) = 0.5\left(1 + \frac{R_{mag}(k)}{L_{mag}(k)}\right)(L_r(k)\cos(\theta(b)) + L_i(k)\sin(\theta(b))); \text{ and}$$

$$M_i(k) = 0.5\left(1 + \frac{R_{mag}(k)}{L_{mag}(k)}\right)(L_i(k)\cos(\theta(b)) - L_r(k)\sin(\theta(b))),$$

where k is the frequency point index, $L_r(k)$ is a real part of the left sound channel signal at a $k^{th}$ frequency point after time-frequency transform, $L_i(k)$ is an imaginary part of the left sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

If the first sound channel is the right sound channel: the phase difference between the downmixed signal and the right sound channel signal in each frequency band is calculated according to the following formula:

$$\theta(b) = \frac{c(b)}{1 + c(b)} \cdot IPD(b);$$

$$\text{where } c(b) = 10^{CLD(b)/10}.$$

As energy of the left sound channel signal increases, the phase difference between the downmixed signal and the left sound channel signal decreases; and as energy of the right sound channel signal increases, the phase difference between the downmixed signal and the right sound channel signal decreases.

S107: Calculate the frequency domain downmixed signal. The frequency domain downmixed signal is calculated according to the following formulas:

$$M_i(k) = 0.5\left(1 + \frac{L_{mag}(k)}{R_{mag}(k)}\right)(R_i(k)\cos(\theta(b)) + R_r(k)\sin(\theta(b))); \text{ and}$$

$$M_r(k) = 0.5\left(1 + \frac{L_{mag}(k)}{R_{mag}(k)}\right)(R_r(k)\cos(\theta(b)) - R_i(k)\sin(\theta(b))),$$

where k is the frequency point index, $L_r(k)$ is a real part of the left sound channel signal at a $k^{th}$ frequency point after time-frequency transform, $L_i(k)$ is an imaginary part of the left sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

After the frequency domain downmixed signal is calculated in S107, the method according to the embodiment of the present invention further includes:

obtaining a time domain downmixed signal of the downmixed signal by performing a frequency-time transform; and obtaining a downmixed mono bit stream of the time domain downmixed signal by using a mono encoder, where the mono encoder according to the embodiment of the present invention includes ITU-T G.711.1, G.722, or the like.

When frequency domain transforms used in the mono encoder and the downmixed signal are the same, it may not be required to perform the frequency-time transform, and the frequency domain downmixed signal is directly coded.

In order to maintain consistency between CLDs and IPDs at a encoding end and a decoding end, in the embodiment of the present invention, downmixing is performed by using a quantified CLD and a quantified IPD. A stereo parameter bit stream obtained after quantification of the CLD and the IPD is sent together with the downmixed mono bit stream to the decoding end.

An embodiment of the present invention provides an apparatus for generating a downmixed signal, including: a time-frequency transform unit 201, configured to perform a time-frequency transform on a received left sound channel signal and a received right sound channel signal to obtain a frequency domain signal, and divide the frequency domain signal into several frequency bands; a frequency band calculating unit 203, configured to calculate a sound channel energy ratio and a sound channel phase difference of each frequency band, where the sound channel energy ratio reflects energy ratio information of the left sound channel signal and the right sound channel signal in each frequency band, and the sound channel phase difference reflects phase difference information of the left sound channel signal and the right sound channel signal in each frequency band; a phase difference calculating unit 205, configured to calculate a phase difference between a downmixed signal and a first sound channel signal in each frequency band according to the sound channel energy ratio and the sound channel phase difference, where the first sound channel signal is the left sound channel signal or the right sound channel signal; and a downmixed signal calculating unit 207, configured to calculate a frequency domain downmixed signal according to the left sound channel signal, the right sound channel signal, and the phase difference between the downmixed signal and the first sound channel signal in each frequency band.

The phase difference calculating unit 205 is configured to calculate the phase difference between the downmixed signal and the first sound channel signal in each frequency band according to the sound channel energy ratio and the sound channel phase difference, which includes: the phase difference calculating unit 205 is configured to calculate the phase difference between the downmixed signal and a sound channel having a greater signal amplitude in the left sound channel and the right sound channel according to the sound channel energy ratio and the sound channel phase difference.

When the first sound channel is the left sound channel, the phase difference calculating unit is configured to calculate the phase difference between the downmixed signal and the first sound channel signal in each frequency band according to the sound channel energy ratio and the sound channel phase difference, which specifically includes performing calculation according to the following formulas:

$$c(b) = 10^{CLD(b)/10}; \text{ and}$$

$$\theta(b) = \frac{1}{1 + c(b)} \cdot IPD(b),$$

where CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

When the first sound channel is the right sound channel, the phase difference calculating unit is configured to calculate the phase difference between the downmixed signal and the first sound channel signal in each frequency band according to the sound channel energy ratio and the sound channel phase difference, which specifically includes performing calculation according to the following formulas:

$$c(b) = 10^{CLD(b)/10}; \text{ and}$$

$$\theta(b) = \frac{c(b)}{1 + c(b)} \cdot IPD(b),$$

where CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

The phase difference calculating unit, in addition to being configured to calculate the phase difference between the downmixed signal and the first sound channel signal in each frequency band according to the sound channel energy ratio and the sound channel phase difference, is further configured to update the phase difference between the downmixed signal and the first sound channel according to a group phase, where the group phase reflects similarity between frequency domain envelopes of the left sound channel signal and the right sound channel signal.

When the first sound channel is the left sound channel, the downmixed signal calculating unit is configured to calculate the frequency domain downmixed signal according to the left sound channel signal, the right sound channel signal, and the phase difference between the downmixed signal and the first sound channel signal in each frequency band, which specifically includes performing calculation according to the following formulas:

$$M_r(k) = 0.5\left(1 + \frac{R_{mag}(k)}{L_{mag}(k)}\right)(L_r(k)\cos(\theta(b)) + L_i(k)\sin(\theta(b))); \text{ and}$$

$$M_i(k) = 0.5\left(1 + \frac{R_{mag}(k)}{L_{mag}(k)}\right)(L_i(k)\cos(\theta(b)) - L_r(k)\sin(\theta(b))),$$

where k is the frequency point index, $L_r(k)$ is a real part of the left sound channel signal at a $k^{th}$ frequency point after time-frequency transform, $L_i(k)$ is an imaginary part of the left sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

When the first sound channel is the right sound channel, the downmixed signal calculating unit is configured to calculate the frequency domain downmixed signal according to the left sound channel signal, the right sound channel signal, and the phase difference between the downmixed signal and the first sound channel signal in each frequency band, which specifically includes performing calculation according to the following formulas:

$$M_i(k) = 0.5\left(1 + \frac{L_{mag}(k)}{R_{mag}(k)}\right)(R_i(k)\cos(\theta(b)) + R_r(k)\sin(\theta(b))); \text{ and}$$

$$M_r(k) = 0.5\left(1 + \frac{L_{mag}(k)}{R_{mag}(k)}\right)(R_r(k)\cos(\theta(b)) - R_i(k)\sin(\theta(b))),$$

where k is the frequency point index, $R_r(k)$ is a real part of the right sound channel signal at a $k^{th}$ frequency point after time-frequency transform, $R_i(k)$ is an imaginary part of the right sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

Figure 3:
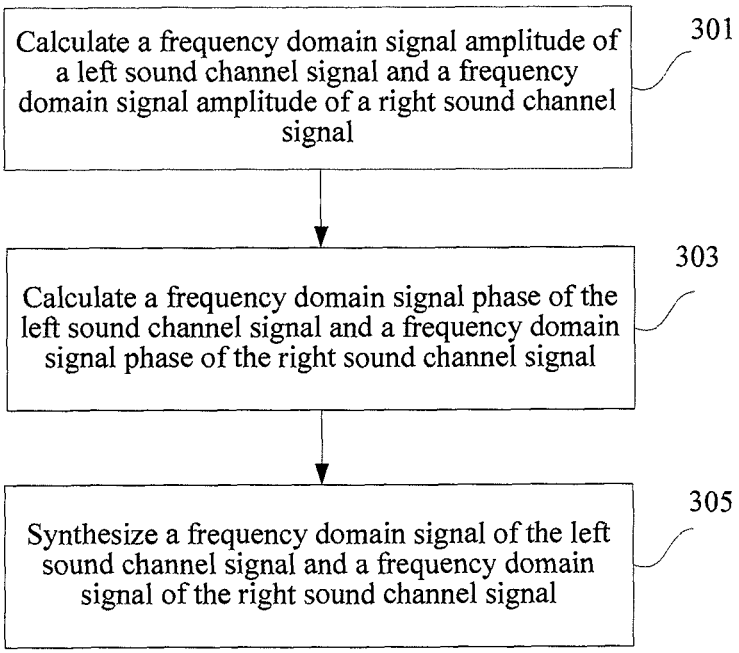
FIG. 3 is a flowchart of a method for restoring a downmixed signal according to an embodiment of the present invention.
Figure 4:
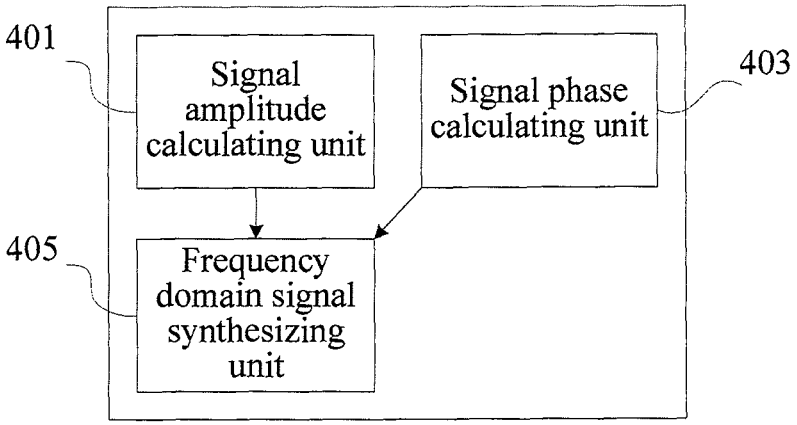
FIG. 4 is a structural diagram of an apparatus for restoring a downmixed signal according to an embodiment of the present invention.

An embodiment of the present invention provides a method for restoring a downmixed signal, and as shown in FIG. 3, FIG. 3 provides a flowchart of the method of an embodiment of the present invention, including:

S301: Calculate a frequency domain signal amplitude of a left sound channel signal and a frequency domain signal amplitude of a right sound channel signal separately according to a frequency domain signal amplitude of the downmixed signal and a received sound channel energy ratio.

S303: Calculate a frequency domain signal phase of the left sound channel signal and a frequency domain signal phase of the right sound channel signal separately according to a frequency domain signal phase of the downmixed signal, the received sound channel energy ratio, and a received sound channel phase difference, where the sound channel phase difference reflects phase difference information of the left sound channel signal and the right sound channel signal in each frequency band.

S305: Synthesize a frequency domain signal of the left sound channel signal according to the frequency domain signal amplitude and the frequency domain signal phase of the left sound channel signal, and synthesize a frequency domain signal of the right sound channel signal according to the frequency domain signal amplitude and the frequency domain signal phase of the right sound channel signal.

In an embodiment of the present invention, a downmixed mono time domain signal is obtained by decoding by using a mono decoder, and stereo parameters, namely a CLD and an IPD, are obtained by decoding by using a dequantizer. The downmixed time domain signal undergoes a time-frequency transform to obtain a frequency domain signal.

S301: Calculate a frequency domain signal amplitude of a left sound channel signal and a frequency domain signal amplitude of a right sound channel signal separately according to a frequency domain signal amplitude of the downmixed signal and a received sound channel energy ratio, which specifically includes performing calculation according to the following formulas:

$$c(b) = 10^{CLD(b)/10},$$

$$|L(k)| = \frac{c(b)}{1 + c(b)} \cdot |M(k)|, \text{ and}$$

-continued $$|R(k)| = \frac{1}{1 + c(b)} \cdot |M(k)|,$$

where k is a frequency point index, CLD(b) is the sound channel energy ratio being a sound channel energy ratio in a $b^{th}$ frequency band, c(b) is an intermediate value variable for calculation, |M(k)| is a frequency domain signal amplitude of a downmixed signal M(k) at a frequency point k, |L(k)| is a frequency domain signal amplitude of a left sound channel signal L(k) at the frequency point k, and |R(k)| is a frequency domain signal amplitude of a right sound channel signal R(k) at the frequency point k.

S303: Calculate a frequency domain signal phase of the left sound channel signal and a frequency domain signal phase of the right sound channel signal separately according to a frequency domain signal phase of the downmixed signal, the sound channel energy ratio, and a sound channel phase difference, which specifically includes performing calculation according to the following formulas:

$$c(b) = 10^{CLD(b)/10},$$

$$\angle L(k) = \angle M(k) + \frac{1}{1 + c(b)} \cdot IPD(b); \text{ and}$$

$$\angle R(k) = \angle M(k) - \frac{c(b)}{1 + c(b)} \cdot IPD(b),$$

where c(b) is an intermediate value variable for calculation, IPD(b) is the sound channel phase difference being a sound channel phase difference in a $b^{th}$ frequency band, ∠M(k) is a frequency domain signal phase of a downmixed signal M(k) at a frequency point k, ∠L(k) is a frequency domain signal phase of a left sound channel signal L(k) at the frequency point k, and ∠R(k) is a frequency domain signal phase of a right sound channel signal R(k) at the frequency point k.

In an embodiment of the present invention, a value range of the IPD is (−pi, pi].

After the frequency domain signal of the left sound channel signal is synthesized according to the frequency domain signal amplitude and the frequency domain signal phase of the left sound channel signal, and the frequency domain signal of the right sound channel signal is synthesized according to the frequency domain signal amplitude and the frequency domain signal phase of the right sound channel signal in S305, the frequency domain signal undergoes a frequency-time transform to obtain time domain decoded signals of left and right sound channels.

An embodiment of the present invention provides an apparatus for restoring a downmixed signal, including: a signal amplitude calculating unit 401, configured to calculate a frequency domain signal amplitude of a left sound channel signal and a frequency domain signal amplitude of a right sound channel signal separately according to a frequency domain signal amplitude of the downmixed signal and a received sound channel energy ratio, where the sound channel energy ratio reflects energy ratio information of the left sound channel signal and the right sound channel signal in each frequency band; a signal phase calculating unit 403, configured to calculate a frequency domain signal phase of the left sound channel signal and a frequency domain signal phase of the right sound channel signal separately according to a frequency domain signal phase of the downmixed signal, the received sound channel energy ratio, and a received sound channel phase, difference, where the sound channel phase difference reflects phase difference information of the left sound channel signal and the right sound channel signal in each frequency band; and a frequency domain signal synthesizing unit 405, configured to synthesize a frequency domain signal of the left sound channel signal according to the frequency domain signal amplitude and the frequency domain signal phase of the left sound channel signal, and synthesize a frequency domain signal of the right sound channel signal according to the frequency domain signal amplitude and the frequency domain signal phase of the right sound channel signal.

The signal amplitude calculating unit 401 is configured to calculate the frequency domain signal amplitude of the left sound channel signal and the frequency domain signal amplitude of the right sound channel signal separately according to the frequency domain signal amplitude of the downmixed signal and the received sound channel energy ratio, which specifically includes performing calculation according to the following formulas:

$$c(b) = 10^{CLD(b)/10},$$

$$|L(k)| = \frac{c(b)}{1 + c(b)} \cdot |M(k)|, \text{ and}$$

$$|R(k)| = \frac{1}{1 + c(b)} \cdot |M(k)|,$$

where k is a frequency point index, CLD(b) is the sound channel energy ratio being a sound channel energy ratio in a $b^{th}$ frequency band, c(b) is an intermediate value variable for calculation, |M(k)| is a frequency domain signal amplitude of a downmixed signal M(k) at a frequency point k, |L(k)| is a frequency domain signal amplitude of a left sound channel signal L(k) at the frequency point k, and |R(k)| is a frequency domain signal amplitude of a right sound channel signal R(k) at the frequency point k.

The signal phase calculating unit 403 is configured to calculate the frequency domain signal phase of the left sound channel signal and the frequency domain signal phase of the right sound channel signal separately according to the frequency domain signal phase of the downmixed signal, the sound channel energy ratio, and the sound channel phase difference, which specifically includes performing calculation according to the following formulas:

$$c(b) = 10^{CLD(b)/10},$$

$$\angle L(k) = \angle M(k) + \frac{1}{1 + c(b)} \cdot IPD(b); \text{ and}$$

$$\angle R(k) = \angle M(k) - \frac{c(b)}{1 + c(b)} \cdot IPD(b),$$

where c(b) is an intermediate value variable for calculation, IPD(b) is the sound channel phase difference being a sound channel phase difference in a $b^{th}$ frequency band, ∠M(k) is a frequency domain signal phase of a downmixed signal M(k) at a frequency point k, ∠L(k) is a frequency domain signal phase of a left sound channel signal L(k) at the frequency point k, and ∠R(k) is a frequency domain signal phase of a right sound channel signal R(k) at the frequency point k.

It should be understood by a person skilled in the art that, modules in an apparatus according to an embodiment may be distributed in the apparatus of the embodiment according to the description of the embodiment, or be correspondingly changed to be disposed in one or more apparatuses different from this embodiment. The modules of the above embodiment may be combined into one module, or further divided into a plurality of sub-modules.

Finally, it should be noted that the above embodiments are merely provided for describing the technical solutions of the present invention, but not intended to limit the present invention. It should be understood by a person of ordinary skill in the art that although the present invention has been described in detail with reference to the embodiments, modifications can be made to the technical solutions described in the embodiments, or equivalent replacements can be made to some technical features in the technical solutions, as long as such modifications or replacements do not cause the essence of corresponding technical solutions to depart from the spirit and scope of the present invention.

What is claimed is:

1. A method for generating a downmixed signal, the method comprising:

performing a time-frequency transform on a left sound channel signal and a right sound channel signal to obtain a frequency domain signal, and dividing the frequency domain signal into several frequency bands;

calculating a sound channel energy ratio and a sound channel phase difference of each frequency band, wherein the sound channel energy ratio reflects energy ratio information of the left sound channel signal and the right sound channel signal in each frequency band, and the sound channel phase difference reflects phase difference information of the left sound channel signal and the right sound channel signal in each frequency band;

calculating a phase difference between the downmixed signal and a first sound channel signal in each frequency band according to the sound channel energy ratio and the sound channel phase difference, wherein the first sound channel signal is the left sound channel signal or the right sound channel signal; and calculating a frequency domain downmixed signal according to the left sound channel signal, the right sound channel signal, and the phase difference between the downmixed signal and the first sound channel signal in each frequency band;

wherein the first sound channel signal is a signal having a greater signal amplitude in the left sound channel signal and the right sound channel signal, and calculating a phase difference between the downmixed signal and a first sound channel signal in each frequency band according to the sound channel energy ratio and the sound channel phase difference comprises: calculating the phase difference between the downmixed signal and the signal having the greater signal amplitude in the left sound channel signal and the right sound channel signal according to the sound channel energy ratio and the sound channel phase difference.

2. A method for generating a downmixed signal, the method comprising:

performing a time-frequency transform on a left sound channel signal and a right sound channel signal to obtain a frequency domain signal, and dividing the frequency domain signal into several frequency bands;

calculating a sound channel energy ratio and a sound channel phase difference of each frequency band, wherein the sound channel energy ratio reflects energy ratio information of the left sound channel signal and the right sound channel signal in each frequency band, and the sound channel phase difference reflects phase difference information of the left sound channel signal and the right sound channel signal in each frequency band;

calculating a phase difference between the downmixed signal and a first sound channel signal in each frequency band according to the sound channel energy ratio and the sound channel phase difference, wherein the first sound channel signal is the left sound channel signal or the right sound channel signal; and calculating a frequency domain downmixed signal according to the left sound channel signal, the right sound channel signal, and the phase difference between the downmixed signal and the first sound channel signal in each frequency band;

wherein the first sound channel is the left sound channel, and calculating a phase difference between the downmixed signal and a first sound channel signal in each frequency band according to the sound channel energy ratio and the sound channel phase difference comprises performing calculation according to the following formulas:

$$c(b) = 10^{CLD(b)/10}; \text{ and}$$

$$\theta(b) = \frac{1}{1 + c(b)} \cdot IPD(b),$$

wherein CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

3. The method according to claim 2, wherein the first sound channel is the left sound channel, and calculating a frequency domain downmixed signal according to the left sound channel signal, the right sound channel signal, and the phase difference between the downmixed signal and the first sound channel signal in each frequency band comprises performing calculation according to the following formulas:

$$M_r(k) = 0.5\left(1 + \frac{R_{mag}(k)}{L_{mag}(k)}\right)(L_r(k)\cos(\theta(b)) + L_i(k)\sin(\theta(b))); \text{ and}$$

$$M_i(k) = 0.5\left(1 + \frac{R_{mag}(k)}{L_{mag}(k)}\right)(L_i(k)\cos(\theta(b)) - L_r(k)\sin(\theta(b))),$$

wherein k is a frequency point index, $L_r(k)$ is a real part of the left sound channel signal at a $k^{th}$ frequency point after time-frequency transform, $L_i(k)$ is an imaginary part of the left sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

4. The method according to claim 3, wherein:

after calculating a phase difference between the downmixed signal and a first sound channel signal in each frequency band according to the sound channel energy ratio and the sound channel phase difference, the method further comprises:

updating the phase difference between the downmixed signal and the first sound channel signal in each frequency band according to a group phase, wherein the group phase reflects similarity between frequency domain envelopes of the left sound channel signal and the right sound channel signal; and calculating a frequency domain downmixed signal according to the left sound channel signal, the right sound channel signal, and the phase difference between the downmixed signal and the first sound channel signal in each frequency band comprises:

calculating the frequency domain downmixed signal according to the left sound channel signal, the right sound channel signal, and updated phase difference between the downmixed signal and the first sound channel signal in each frequency band.

5. A method for generating a downmixed signal, the method comprising:

performing a time-frequency transform on a left sound channel signal and a right sound channel signal to obtain a frequency domain signal, and dividing the frequency domain signal into several frequency bands;

calculating a sound channel energy ratio and a sound channel phase difference of each frequency band, wherein the sound channel energy ratio reflects energy ratio information of the left sound channel signal and the right sound channel signal in each frequency band, and the sound channel phase difference reflects phase difference information of the left sound channel signal and the right sound channel signal in each frequency band;

calculating a phase difference between the downmixed signal and a first sound channel signal in each frequency band according to the sound channel energy ratio and the sound channel phase difference, wherein the first sound channel signal is the left sound channel signal or the right sound channel signal; and calculating a frequency domain downmixed signal according to the left sound channel signal, the right sound channel signal, and the phase difference between the downmixed signal and the first sound channel signal in each frequency band;

wherein the first sound channel is the right sound channel, and calculating a phase difference between the downmixed signal and a first sound channel signal in each frequency band according to the sound channel energy ratio and the sound channel phase difference comprises performing calculation according to the following formulas:

$$c(b) = 10^{CLD(b)/10}; \text{ and}$$

$$\theta(b) = \frac{c(b)}{1 + c(b)} \cdot IPD(b),$$

wherein CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

6. The method according to claim 5, wherein the first sound channel is the right sound channel, and calculating a frequency domain downmixed signal according to the left sound channel signal, the right sound channel signal, and the phase difference between the downmixed signal and the first sound channel signal in each frequency band comprises performing calculation according to the following formulas:

$$M_i(k) = 0.5\left(1 + \frac{L_{mag}(k)}{R_{mag}(k)}\right)(R_i(k)\cos(\theta(b)) + R_r(k)\sin(\theta(b))); \text{ and}$$

$$M_r(k) = 0.5\left(1 + \frac{L_{mag}(k)}{R_{mag}(k)}\right)(R_r(k)\cos(\theta(b)) - R_i(k)\sin(\theta(b))),$$

wherein k is a frequency point index, $R_r(k)$ is a real part of the right sound channel signal at a $k^{th}$ frequency point after time-frequency transform, $R_i(k)$ is an imaginary part of the right sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

7. An apparatus for generating a downmixed signal, the apparatus comprising:

a processor; and a non-transitory computer-readable medium coupled to the processor and storing programming instructions for execution by the processor, the programming instructions instruct the processor to:

perform a time-frequency transform on a received left sound channel signal and a received right sound channel signal to obtain a frequency domain signal, and divide the frequency domain signal into several frequency bands;

calculate a sound channel energy ratio and a sound channel phase difference of each frequency band, wherein the sound channel energy ratio reflects energy ratio information of the left sound channel signal and the right sound channel signal in each frequency band, and the sound channel phase difference reflects phase difference information of the left sound channel signal and the right sound channel signal in each frequency band;

calculate a phase difference between the downmixed signal and a first sound channel signal in each frequency band according to the sound channel energy ratio and the sound channel phase difference, wherein the first sound channel signal is the left sound channel signal or the right sound channel signal;

calculate a frequency domain downmixed signal according to the left sound channel signal, the right sound channel signal, and the phase difference between the downmixed signal and the first sound channel signal in each frequency band; and calculate the phase difference between the downmixed signal and a sound channel signal having a greater amplitude in the left sound channel signal and the right sound channel signal in each frequency band according to the sound channel energy ratio and the sound channel phase difference.

8. The apparatus according to claim 7, wherein the first sound channel is the right sound channel, and the programming instructions instruct the processor to calculate the phase difference between the downmixed signal and the first sound channel signal in each frequency band according to the following formulas:

$$c(b) = 10^{CLD(b)/10}; \text{ and}$$

$$\theta(b) = \frac{c(b)}{1 + c(b)} \cdot IPD(b),$$

wherein CLD(b) is the sound channel energy ratio of a $b^{th}$ frequency band, c(b) is an intermediate value variable for calculation, IPD(b) is the sound channel phase difference of the bth frequency band, and θ(b) is a phase difference between the downmixed signal and the first sound channel signal in the bth frequency band.

9. The apparatus according to claim 8, wherein the first sound channel is the left sound channel, and the programming instructions instruct the processor to calculate the frequency domain downmixed signal according to the following formulas:

$$M_r(k) = 0.5\left(1 + \frac{R_{mag}(k)}{L_{mag}(k)}\right)(L_r(k)\cos(\theta(b)) + L_i(k)\sin(\theta(b))); \text{ and}$$

$$M_i(k) = 0.5\left(1 + \frac{R_{mag}(k)}{L_{mag}(k)}\right)(L_i(k)\cos(\theta(b)) - L_r(k)\sin(\theta(b))),$$

wherein k is a frequency point index, $L_r(k)$ is a real part of the left sound channel signal at a kth frequency point after time-frequency transform, $L_i(k)$ is an imaginary part of the left sound channel signal at the kth frequency point after the time-frequency transform, $R_{mag}(k)$ is an amplitude of the right sound channel signal at the kth frequency point after the time-frequency transform, $L_{mag}(k)$ is an amplitude of the left sound channel signal at the kth frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

10. The apparatus according to claim 7, wherein the first sound channel is the left sound channel, and the programming instructions instruct the processor to calculate the phase difference between the downmixed signal and the first sound channel signal in each frequency band according to the following formulas:

$$c(b) = 10^{CLD(b)/10}; \text{ and}$$

$$\theta(b) = \frac{1}{1 + c(b)} \cdot IPD(b),$$

wherein CLD(b) is the sound channel energy ratio of a $b^{th}$ frequency band, c(b) is an intermediate value variable for calculation, IPD(b) is the sound channel phase difference of the $b^{th}$ frequency band, and θ(b) is a phase difference between the downmixed signal and the first sound channel signal in the $b^{th}$ frequency band.

11. The apparatus according to claim 10, wherein the first sound channel is the right sound channel, and the programming instructions instruct the processor to calculate the frequency domain downmixed signal according to the following formulas:

$$M_i(k) = 0.5\left(1 + \frac{L_{mag}(k)}{R_{mag}(k)}\right)(R_i(k)\cos(\theta(b)) + R_r(k)\sin(\theta(b))); \text{ and}$$

$$M_r(k) = 0.5\left(1 + \frac{L_{mag}(k)}{R_{mag}(k)}\right)(R_r(k)\cos(\theta(b)) - R_i(k)\sin(\theta(b))),$$

wherein k is a frequency point index and is a natural number, $R_r(k)$ is a real part of the right sound channel signal at a $k^{th}$ frequency point after time-frequency transform, $R_i(k)$ is an imaginary part of the right sound channel signal at the $k^{th}$ frequency point after the time-frequency transform, $R_{mag}(k)$ is an amplitude of the right sound channel signal at the $k^{th}$ frequency point after the time-frequency transform, $L_{mag}(k)$ is an amplitude of the left sound channel signal at the $k^{th}$ frequency point after the time-frequency transform, $M_i(k)$ is a real part of the downmixed signal at the $k^{th}$ frequency point after the time-frequency transform, $M_r(k)$ is an imaginary part of the downmixed signal at the $k^{th}$ frequency point after the time-frequency transform, and θ(b) is the phase difference between the downmixed signal and the first sound channel signal in the $b^{th}$ frequency band.

12. The apparatus according to claim 9 wherein the programming instructions instruct the processor to update the phase difference between the downmixed signal and the first sound channel according to a group phase, wherein the group phase reflects similarity between frequency domain envelopes of the left sound channel signal and the right sound channel signal.

* * * * *